US005706948A

United States Patent [19]

Hughes

[11] Patent Number: 5,706,948

[45] **Date of Patent: *Jan. 13, 1998**

[54] METHOD FOR IDENTIFYING A CHARACTERISTIC OF AN OBJECT OR CONTENTS OF A CONTAINER

[76] Inventor: D. Michael Hughes, Broken Arrow Ranch, Ingram, Tex. 78025

[ * ] Notice: The term of this patent shall not extend beyond the expiration date of Pat. No. 5,520,278.

[21] Appl. No.: 652,293

[22] Filed: May 23, 1996

Related U.S. Application Data

[63] Continuation-in-part of Ser. No. 524,764, Sep. 7, 1995, Pat. No. 5,520,278, which is a continuation-in-part of Ser. No. 278,150, Jul. 21, 1994, abandoned.

[51] Int. Cl.[6] ..... G09F 3/00

[52] U.S. Cl. ..... 206/459.5; 40/299; 40/310

[58] Field of Search ..... 206/459.5, 459.1, 206/216, 217; 40/299, 310, 311, 331, 324

[56] References Cited

U.S. PATENT DOCUMENTS

| | | |
|---|---|---|
| 1,948,358 | 2/1934 | Reil . |
| 2,219,834 | 10/1940 | Davis . |
| 2,245,964 | 6/1941 | Cronenwett . |
| 2,507,794 | 5/1950 | Longnecker . |
| 2,527,175 | 10/1950 | Brill . |
| 2,540,718 | 2/1951 | Duskin . |
| 3,072,246 | 1/1963 | Goldstein . |
| 3,315,386 | 4/1967 | Kest et al. . |
| 3,355,830 | 12/1967 | Hoffman . |
| 3,978,902 | 9/1976 | Adkison . |
| 4,054,105 | 10/1977 | Fegan . |
| 4,092,191 | 5/1978 | Jones . |
| 4,108,103 | 8/1978 | Ammar . |
| 4,352,253 | 10/1982 | Oswalt . |
| 4,389,963 | 6/1983 | Pearson . |
| 4,589,685 | 5/1986 | Lazar . |
| 4,680,882 | 7/1987 | Watson, Jr. . |
| 4,752,087 | 6/1988 | Weisbach . |
| 5,240,755 | 8/1993 | Zimmer . |
| 5,520,278 | 5/1996 | Hughes ..... 206/459.5 |

FOREIGN PATENT DOCUMENTS

| | | |
|---|---|---|
| 8522043 | 10/1985 | Germany . |
| 8913262 | 2/1990 | Germany . |

*Primary Examiner*—Jacob K. Ackun
*Attorney, Agent, or Firm*—Jenkens & Gilchrist, P.C.

[57] ABSTRACT

A method for selectively indicating a changeable characteristic of an article or of the contents of a container includes use of mnemonic device comprising a body having a plurality of predefined indicator marks placed thereon, and a means associated with each one of the indicator marks by which the device can be selectively attached to the container or article. The placement of the attachment means is such that the attachment point of the indicating device 10 is unambiguously associated with only a single one of the indicator marks 14.

14 Claims, 4 Drawing Sheets

METHOD FOR IDENTIFYING A CHARACTERISTIC OF AN OBJECT OR CONTENTS OF A CONTAINER

This application is a continuation-in-part application of application Ser. No. 08/524,764 filed Sep. 7, 1995 and assigned Pat. No. 5,520,278 to be issued May 28, 1996, which is a continuation-in-part of application Ser. No. 08/278,150 filed Jul. 21, 1994, now abandoned.

BACKGROUND OF THE INVENTION

1. Technical Field

This invention relates generally to a method for selectively indicating a predefined characteristic of the contents of a container or status of an object, and more particularly to such a method which uses a device having a plurality of indicants and separate means associated with each indicant whereby the device may be selectively attached to the container.

2. Background Art

Around the home, garage, farm or ranch, there has been a long-felt need for a simple and effective method for identifying the contents of a can or bottle. For example, does a gas can contain regular gas or a gas-oil mixture? If a mixture, is it 20:1 or 50:17? If a can or tank contains a previously mixed chemical used in farming or gardening, is it fertilizer, herbicide, pesticide, fungicide, or something else? With respect to engines or motors that use different weight oil in different seasons of the year, is the current oil 10 weight, 30 weight, or multi-viscosity, and when is it due for change?

Thus, it can be readily appreciated that there are numerous situations, often occurring daily, that require accurate identification of the contents of a container. If the contents of a container are misidentified the consequences could, at the very least, be bothersome, and at the worst, catastrophic. Also, it is often desirable to be able to quickly identify the status of an object, for example is a piece of military ordinance or a missile in a "ready" state, on "stand-by" or "hold", "out of service" or other service status.

Furthermore, temporarily marking a container or object with pen, chalk, crayon, etc. is not good practice. For example, the contents of the container may be changed, but the prior indentifier may still be observable. The status of an object may change, but revised status message may be confused with an earlier message. Stick-on labels or tape can become detached or unreadable.

The present invention is directed to overcoming the problems set forth above. It is desirable to have a simple and easily implemented method for selectively identifying the actual contents, i.e., the composition of the material in a container, or a specific condition of the contents such as when the contents are due for change, or the status or condition of an object or article. Specifically, it is desirable to have such a method that uses a simple device which, by the very position at which the device is attached will, by and of itself, readily identify a selected characteristic associated with an object or contents of a container.

Importantly, it is also desirable to have a method for indicating one or more characteristics of a container, its contents, or other object that makes use of a mnemonic device which can be selectively reattached in a different position if the contents of the container change, or if the status, condition, or other changeable characteristic of the container, object or other article changes from that previously identified.

DISCLOSURE OF THE INVENTION

In accordance with one aspect of the present invention, a method for indicating a characteristic of the contents of a container includes providing a mnemonic device having a plurality of predefined indicants disposed thereon and a separate attachment means associated with each of said indicants, determining a characteristic of the contents of the container, and then selecting one of the indicants on the mnemonic device corresponding with the determined characteristic of the contents. The mnemonic device is then attached to the container by the attachment means associated with the selected indicant on the mnemonic device. When the characteristic of the contents of the container changes, the mnemonic device is detached from the container, the changed characteristic determined, and an indicant on the mnemonic device corresponding to the changed characteristic is selected. The mnemonic device is then reattached to the container by the attachment means associated with the indicant corresponding to the changed characteristic of the container contents.

Other features of the method for identifying a characteristic of the contents of a container include the mnemonic device used in carrying out the method having a body portion that has a plurality of predefined surface areas, each of which have a respective one of the indicants disposed thereon and at least a portion of a respective one of the separate attachment means associated with each of the indicants positioned within each of the surface areas. Still other features of the method for identifying a selected characteristic of the contents of a container include determining the composition or the useful service life of the contents of the container.

In accordance with another aspect of the present invention, a method for indicating a changeable characteristic of an object or article includes providing a mnemonic device having a plurality of predefined indicants disposed thereon and a separate attachment means associated with each of said indicants, determining a characteristic of the object, and then selecting one of the indicants on the mnemonic device that corresponds with the determined characteristic of the object. The mnemonic device is then attached to the object by the attachment means associated with the selected indicant on the mnemonic device. When the characteristic of the object changes, the mnemonic device is detached from the object, the changed characteristic determined, and an indicant on the mnemonic device corresponding to the changed characteristic is selected. The mnemonic device is then reattached to the object by the attachment means associated with the indicant corresponding to the changed characteristic of the object.

Other features of the method for identifying a characteristic of the object or article include the mnemonic device used in carrying out the method having a body portion that has a plurality of predefined surface areas, each of which have a respective one of the indicants disposed thereon and at least a portion of a respective one of the separate attachment means associated with each of the indicants positioned within each of the surface areas. Still other features of the method for identifying a selected characteristic of an object include determining the operational status of the object.

DETAILED DESCRIPTION OF A PRESENTLY PREFERRED EXEMPLARY EMBODIMENT

Figure 1:
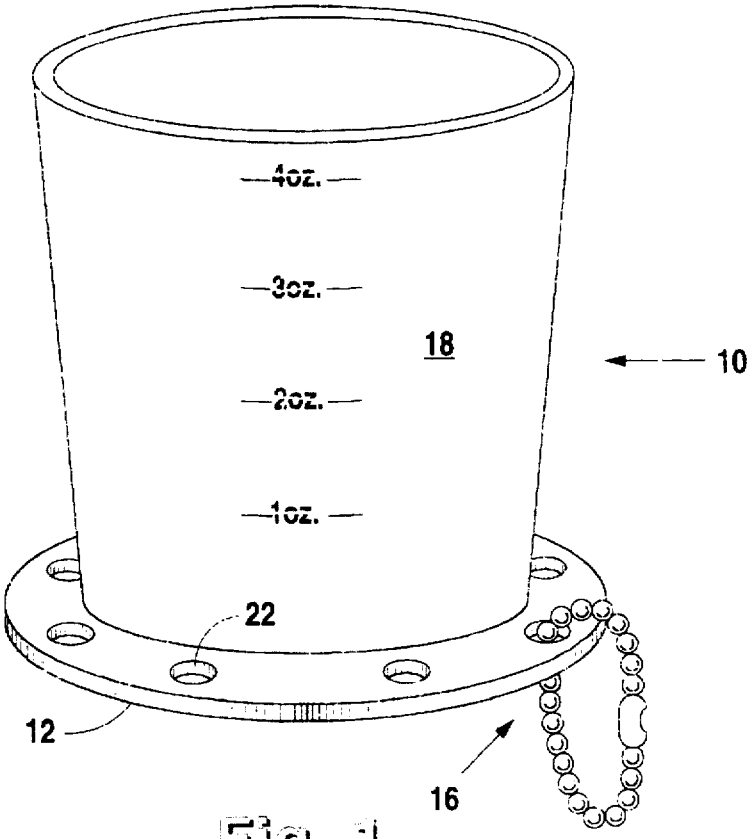
FIG. 1 is a perspective view of a device useful in carrying out the method, embodying the present invention, for identifying a characteristic of the contents of a container.

In FIGS. 1–7, a mnemonic device suitable for use with the method, embodying the present invention, for identifying a changeable characteristic of an object or of the contents of a container, is generally identified by the reference number 10. The term "container", while not specifically shown in any of the drawings, is used in the following specification and claims in a broad sense and includes, by way of example but not limitation, bottles, cans, spray apparatuses, engines crankcases, and machines having fluid storage or collecting chambers such as hydraulic fluid supply tanks. The term "object" or "article", is also used herein in a broad sense and means any object or article having a changeable characteristic such as a next service requirement, operational status, physical condition, and the like. Also, the term "characteristic of the contents of a container", is broadly used in the following specification and claims in a broad sense and includes, by way of example but is not limited to, the material composition of the contents, e.g., gas or oil and blends thereof, kerosene, diesel fuel, naphtha, fertilizer, pesticide, and the like, or an identifiable characteristic related to the service life of the contents, e.g., when should the contents be discarded, changed, or receive some other service directed to the container or its contents.

The mnemonic device 10, also referred to herein as an indicating device, useful in carrying out the present invention includes a body portion 12 having a plurality of predefined indicants or identification marks 14 disposed thereon, and a means 16 associated with each of the indicants 14 for selectively attaching the device 10 to the subject container or object.

Figure 2:
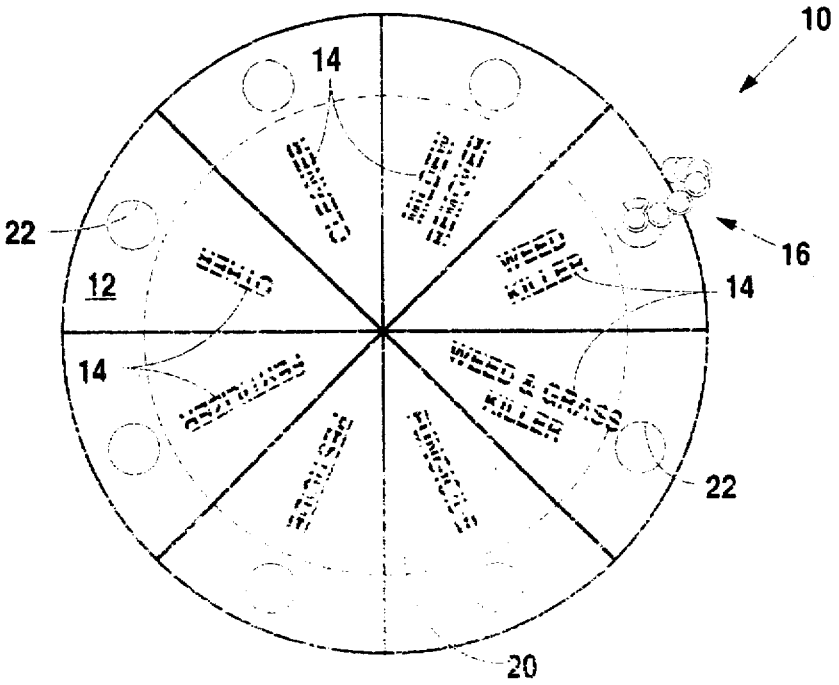
FIG. 2 is a bottom view of the device of FIG. 1, showing the indicating marks and means by which the device is attached to a container.

As shown in FIGS. 1 and 2, the mnemonic or indicating device 10 is an integral part of a volumetric measuring device, such as a measuring cup 18. The indicating device 10 actually forms the base of the cup and has a rim, or flange extending radially outwardly from the cup base. Preferably the cup and flange are formed of a molded plastic material, such as polyethylene or polycarbonate, and the indicants 14, for example as shown in FIG. 2, are raised letters or symbols that are formed on the bottom of the indicating device 10 during the molding process. Alternatively, the indicating marks 14 may be stamped, painted, etched, scribed, attached by adhesive, or otherwise placed upon the indicating device 10. Also, if desired, the indicating device 10 may be molded or formed separately and then assembled, such as by snapping together mating grooves and ridges provided on the indicating device 10 and the measuring device 18.

By way of illustration, the indicants 14 shown in FIG. 2 appropriately identify various concentrated liquid or granulated materials that are typically mixed with water prior to use around a home, garden, farm or ranch. Quite often, not all of the mixed solution is used, and rather than 'dumping' the leftover mixture, it is frequently stored, either in its dispensing container such as a sprayer, or in the mixing container. After a few days, if not properly marked, it is not uncommon for one to be less than certain what is in the container. The present invention overcomes this problem.

Each of the indicants 14 are positioned within a respective predefined surface area 20 which, in the illustrative example shown in FIG. 2, is in the form a pie-shaped segment. Importantly, each of the predefined surface areas 20 having a respective one of the indicants 14 placed thereon, has a separate one of the means 16 for selectively attaching the device 10 to a container. In this example, the means 16 is an aperture 22 extending through each of the pie-shaped segments 20. A conventional tie member, such as the ball-snap key chain shown in FIGS. 1 and 2, or alternatively, a wire twist tie,, a plastic tie, or similar tie may be inserted through the aperture 22 associated with the indicant 14 that correctly corresponds with the contents of a container, and then attached, or fastened to the handle, nozzle, or other part of the container. In this manner, the contents of the container can be readily ascertained by simply looking at the indicating device 10 and observing the identifying mark 14 next to the aperture 22 by which the device 10 is attached to the container.

Figure 3:
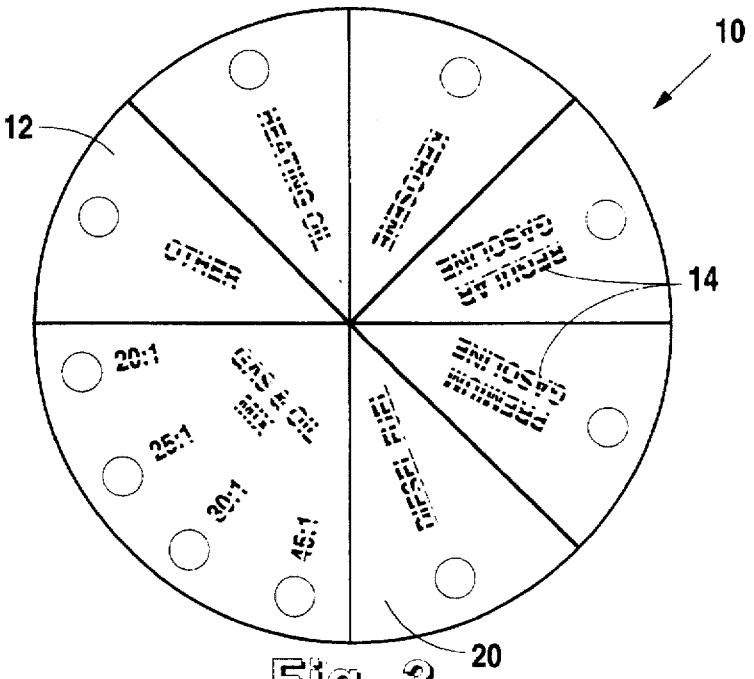
FIG. 3 is a plan view of the body portion of an alternate arrangement of the indicating device useful for carrying out the method embodying the present invention.

An alternative arrangement of the indicants 14 placed on the indicating device 10 is shown in FIG. 3. In this arrangement, which may be used with either a volumetric measuring device 18 such as shown in FIG. 1, or with a flow control device such as a conventional funnel or nozzle, the indicants 14 identify various fuels and fuel mixtures. This arrangement is particularly useful when more than one type of fuel is used at the same location.

Figure 6:
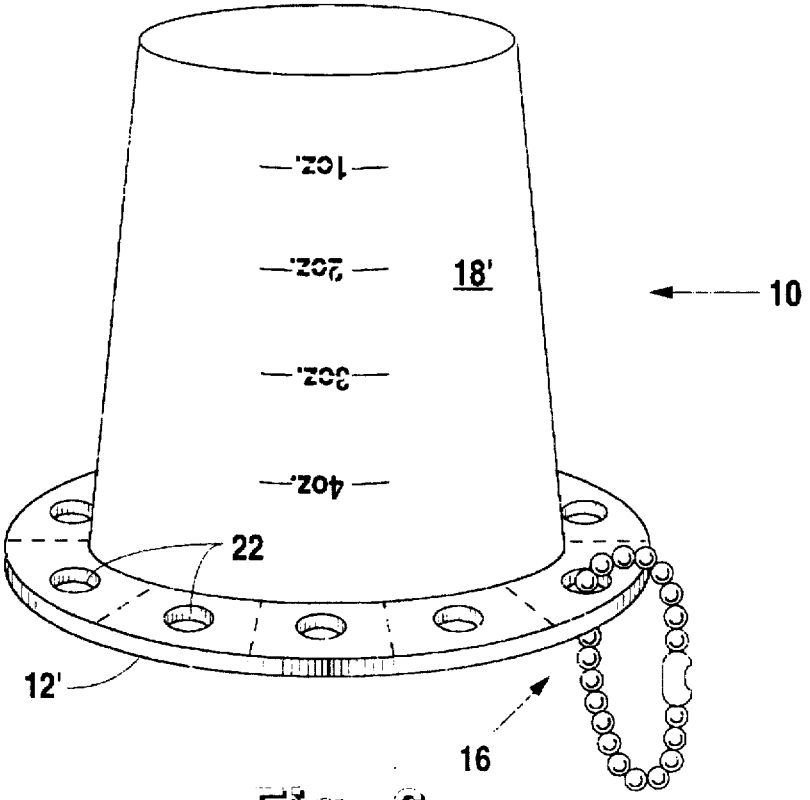
FIG. 6 is a perspective view of an alternative arrangement of the device shown in FIG. 1.
Figure 7:
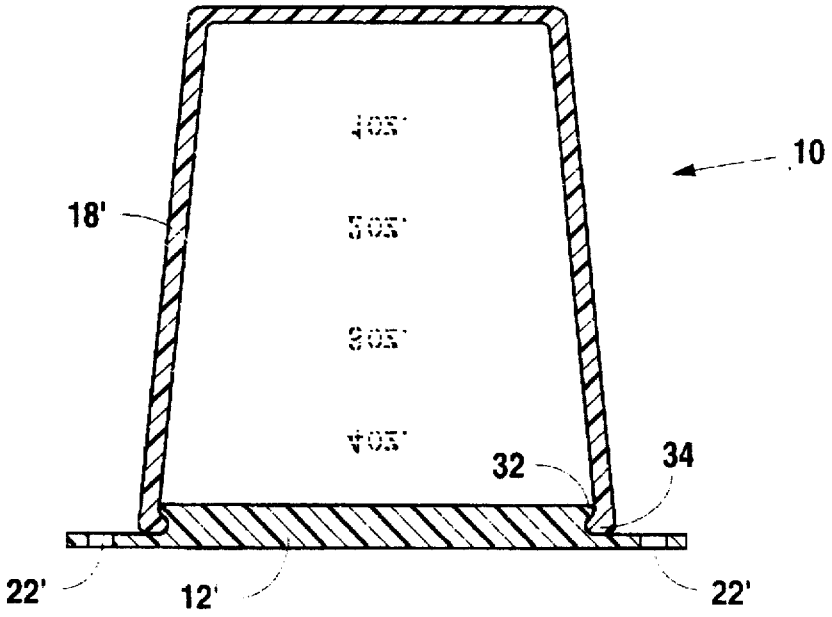
FIG. 7 is a cross-sectional view of the alternative arrangement of the device shown in FIG. 6.

Alternatively, the volumetric measuring device 18 may be separately formed apart from the base, or body portion, on which the indicants 14 are disposed. For example, as shown in FIGS. 6 and 7, the measuring cup 18' may be inverted with the open top of the measuring cup removably attached to the body portion 12'. In this arrangement, the body portion 12' becomes a mounting base for the measuring cup 18'. The body portion 12' has a planar bottom surface and is essentially planar in structure with the exception of a raised lip 32 that may be formed as separate raised tabs, a continuous raised ridge or, as shown in FIG. 7, be formed on the outer edge surface of a centrally disposed raised or stepped area. The lip 32 is shaped to at least partially abut and frictionally engage the inner surface, or rim, 34 of the open end of the cup 18'. Alternatively, the lip 32 may be disposed on the inner peripheral edge surface of a raised flange area of the body portion 12' by which arrangement an inwardly facing lip snaps over, i.e. frictionally engages, an outer surface of the rim of the cup 18'. Also, the removable attachment of the measuring cup 18' to body portion 12' may be provided by mating threads, or tabs and grooves, formed respectively in selected internal or external rim surfaces of the cup 18' and the engagement lip provided on the base 12'.

Desirably, the apertures 22' and the means 16' associated with each of the indicants for selectively attaching the assembled indicating device 10 to a container are provided in the peripheral region of the body portion 12'. This arrangement advantageously positions the apertures 22' and the attachment means 16' outside the central area of the body portion 12' at a location where each attachment means can be visually associated, unambiguously, with a single one of the indicants 14. As in the earlier arrangement, the preselected indicants 14 may be conveniently formed on the bottom surface of the body portion 12'. In either arrangement, the volumetric measuring utensil 18, 18' and the body portion 12, 12' may have a shape other than the circular shape illustrated in the drawings.

Figure 4:
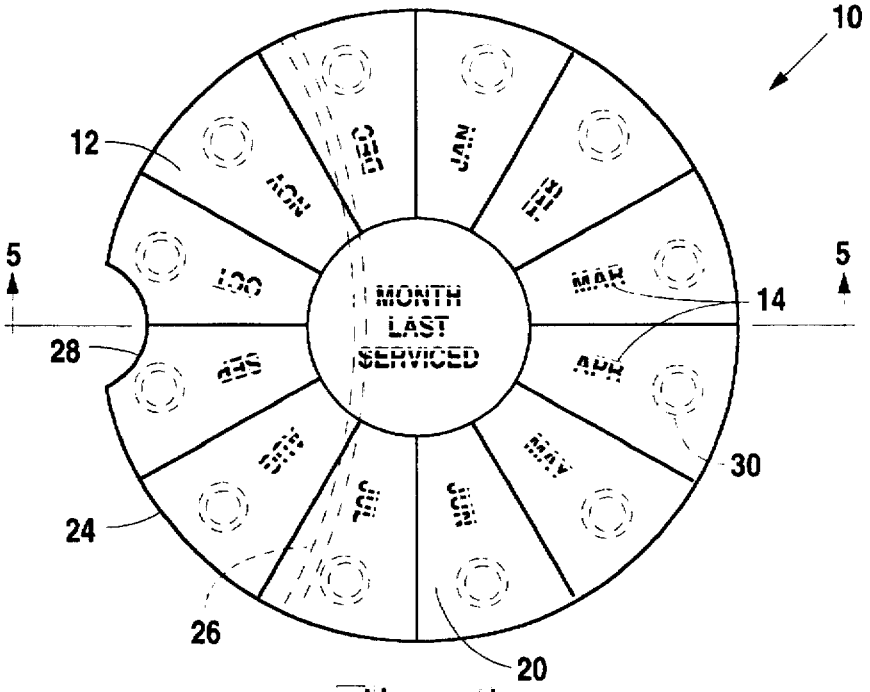
FIG. 4 is a plan view of the body portion of another alternate arrangement of the indicating device useful in carrying out the method embodying the present invention.
Figure 5:
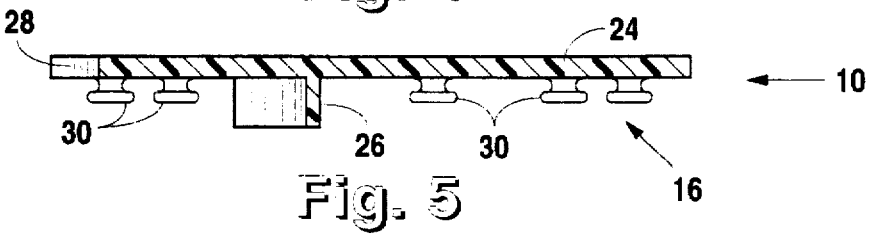
FIG. 5 is a sectional view taken along the line 5—5 in FIG. 4.

Another example of the indicating, or mnemonic, device 10 particularly useful in carrying out the method for identifying a characteristic of the contents of a container, in accordance with the present invention, is shown in FIGS. 4 and 5. In this example, the indicating device 10 is essentially a flexible flat disk 24 having a curved lip 26 extending angularly from the bottom of the disk, and a curved notch 28 at one edge of the disk. The top and bottom edges of the disk, as viewed in FIG. 4, may be bent upwardly to form a curved trough to direct fluid, such as oil, through a filler opening in an engine or machine. When bent, the curved lip is deformed to a smaller radius, and when inserted into a hole having a diameter less than the free shape of the lip, expands outwardly into biased contact with the side of the opening. This spring-like action retains the disk 24 in its flexed, or bent, shape, with the fight side of the disk, as viewed in FIG. 5, at a higher elevation than the left, or notched side, thereby forming a trough-shaped channel to guide the flow of fluid toward the notch and into the opening. As can be appreciated, in this arrangement the indicating device 10 is useful for controlling spills and drips when adding, or replacing, fluids and simultaneously indicating the time, e.g., date, day, week, month or year, when the fluid was added or replaced. Furthermore, this embodiment of the present invention may be suitably attached to an oil or hydraulic fluid dip stick or similar volumetric measuring utensils on an engine or machine.

An alternate means 16 associated with each of the indicants 14 for selectively attaching the indicating device 10 to a container or object is indicated by hidden lines in FIG. 4 and in solid detail in FIG. 5. In this embodiment, the attachment means 16 includes a mechanical button-type snap connector, with a male portion 30 of the snap being permanently attached in close proximity to each of the indicants 14. As best shown in FIG. 4, the snap member 30 may be placed immediately under, or on the opposite side of, each of the predefined surface areas 20 associated with a respective one of the indicating marks 14. In this arrangement, the snap connector is attached to the container, and the characteristics of the contents of the container are indicated by attaching the female portion of the connector to a selected one of the male portions 30. Alternatively, a plurality of the female portions of the connector could be mounted on the indicating device 10 and the single male portion connected to the container.

In a similar manner, the means 16 associated with each of the indicants 14 for selectively identifying the characteristics of the contents of a container may be a conventional matable clasp, such as a mechanical spring-closure hook, a hook-and-loop fabric fastener, or other known fastening device. However, whichever fastening device is used, it is essential that indicating device 10 be capable of being selectively attached to the container in such a manner that the attachment point, or position, of the indicating device 10 be unambiguously associated with only a single one of the identifying marks 14.

The mnemonic device 10 may also be used to indicate an operational characteristic, such as "in service", "out of service", on "standby", the next service date, or other operational state of a container or other object which may comprise a stationary or mobile tank, machine tool, vehicle, weapon, missile, or other article. In this embodiment, the indicants 14 on the body portion 12 would accordingly separately identify the predefined operational characteristics or status and have a means 16 associated with each of the separate indicants 14 for selectively attaching the device 10 to the object.

Figure 8:
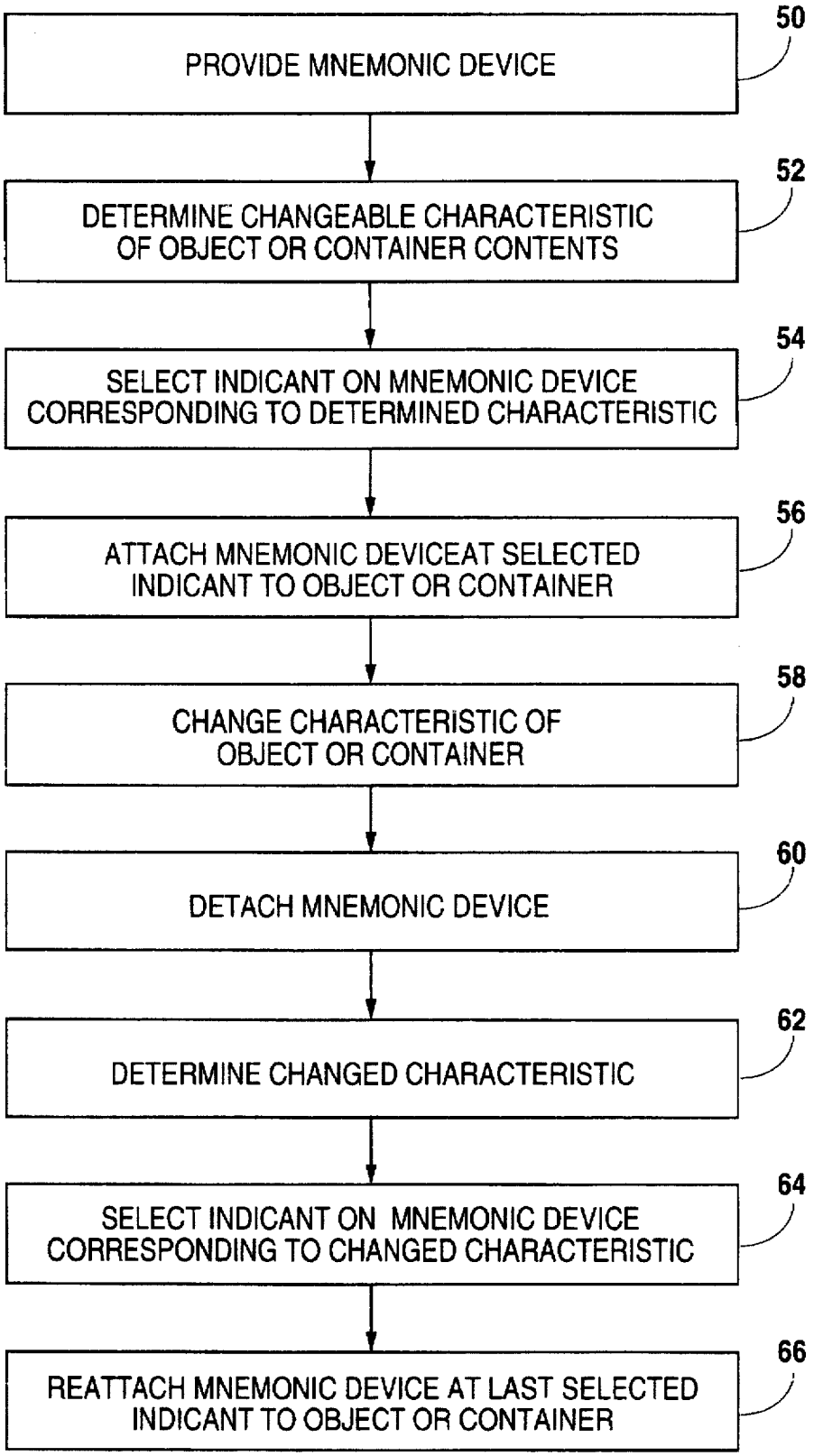
FIG. 8 is a flow diagram of the steps carried out in the method for identifying a characteristic of the contents of a container or status of an object, in accordance with the present invention.

The method, embodying the present invention, for identifying a changeable characteristic of the contents of a container or condition of an object, is illustrated in the flow diagram comprising FIG. 8. As indicated at block 50, a mnemonic device 10 having a plurality of appropriately predefined indicants 14 and a separate attachment means 16 associated with each of the indicants 14 as described above, is provided. Examples of appropriate indicants and attachment devices were also described above with reference to specific embodiments of the mnemonic device 10.

After determining a specific characteristic of the contents of the container such as its composition, or the status of an object such as its operating condition, as indicated at block 52, an appropriate one of the indicants 14 on the mnemonic device 10 is selected, as shown at block 54 to correspond with the determined characteristic. After determination of the chosen characteristic, and selection of the corresponding indicant 14, the mnemonic device 10 is attached to the container or object by way of the attachment means 16 specifically associated with the selected indicant 14, as represented at block 56.

When the characteristic of the contents of the container of status of the object changes, as represented at block 58, the mnemonic device 10 is detached, i.e., removed, from the container or object as shown at block 60. After determining the changed characteristic of the contents of the container or the changed characteristic of an object, at block 62, an indicant 14 on the mnemonic device 10 corresponding to the changed characteristic is selected, at block 64, and the mnemonic device 10 is reattached, as indicated at block 66, to the container or object, by the attachment means 16 unambiguously associated with the indicant 14 corresponding to the changed characteristic.

INDUSTRIAL APPLICABILITY

The present invention provides an effective and economical method for selectively identifying a characteristic of the an object or container, or a characteristic of the contents of a container. In one embodiment a mnemonic device 10, used in carrying out the method, may be comprise a measuring utensil 18, a flow control utensil such as a funnel or deformable flow guide member 26, or other utensil or tool that may be used in conjunction with opening, measuring, mixing or handling of the contents of the container.

An important feature of the present invention is the ability of the indicating device 10 to selectively identify container content or object status characteristics simply by the position of the device 10 when it attached to the container. The attachment position may be selectively changed to indicate a different characteristic if the contents of the container are changed, or if the indicating device 10 is moved to a container having different contents.

The present invention also provides an effective and economical method for indicating the operating status or other characteristic of an article. For example, it is often desirable to indicate whether a particular machine, tool, weapon, or vehicle is operable, out of service, on standby, or due for service at a future time. In this embodiment, the indicating device 10 has a plurality of appropriate messages marked adjacent a corresponding plurality of means for attaching the device 10 to an article.

Importantly, the indicating device 10 embodying the present invention is easily formable of inexpensive, readily moldable or stamped plastic or metallic materials.

Although the present invention is described in terms of preferred exemplary embodiments, those skilled in the art will recognize that changes in the order in which certain defined steps are carried out. For example, the order in which certain steps of the method such as changing the contents of a container or condition of an object and detaching the mnemonic device, may be interchanged without departing from the spirit of the invention. Such changes are intended to fall within the scope of the following claims. Other aspects, features and advantages of the present invention can be obtained from a study of this disclosure together with the appended claims.

What is claimed is:

1. A method for identifying a characteristic of the contents of a container, comprising:

providing a mnemonic device having a plurality of predefined indicants disposed thereon and a separate attachment means associated with each of said indicants;

determining a characteristic of the contents of said container;

selecting an indicant on the mnemonic device corresponding to the determined characteristic of the container contents;

attaching the mnemonic device to said container by the attachment means associated with said selected indicant on the mnemonic device;

changing the characteristic of the contents of said container;

detaching the mnemonic device from said container;

determining the changed characteristic of the contents of said container;

selecting an indicant on the mnemonic device corresponding to the changed characteristic of the container contents; and reattaching the mnemonic device to said container by the attachment means associated with the indicant on the mnemonic device corresponding to the changed characteristic of the container contents.

2. A method for identifying a characteristic of the contents of a container, as set forth in claim 1, wherein said mnemonic device includes a body portion having a plurality of predefined surface areas each having a respective one of said indicants disposed thereon, and at least a portion of a respective one of said separate attachment means associated with each of said indicants is positioned within each of said surface areas.

3. A method for identifying a characteristic of the contents of a container, as set forth in claim 2, wherein each of said separate attachment means associated with each of said indicants comprises an aperture formed in each of said predefined surface areas and adapted to receive a single detachable connector extending through a selected one of said apertures.

4. A method for identifying a characteristic of the contents of a container, as set forth in claim 2, wherein said separate attachment means associated with each of said indicants comprises a matable clasp member positioned in unambiguous proximity each of said indicants, and a single mating connector adapted to engage a selected one of said clasp members.

5. A method for identifying a characteristic of the contents of a container, as set forth in claim 2, wherein said mnemonic device includes a volumetric measuring utensil and said body portion of the device is fixedly connected to said measuring utensil.

6. A method for identifying a characteristic of the contents of a container, as set forth in claim 1, wherein said determining a characteristic of the contents of said container and said determining the changed characteristic of the contents of said container includes determining the composition of said contents.

7. A method for identifying a characteristic of the contents of a container, as set forth in claim 1, wherein said determining a characteristic of the contents of said container and said determining the changed characteristic of the contents of said container includes determining a useful service life for said contents.

8. A method for identifying a changeable characteristic of an object, comprising:

providing a mnemonic device having a plurality of predefined indicants disposed thereon and a separate attachment means associated with each of said indicants;

determining a characteristic of said object;

selecting an indicant on the mnemonic device corresponding to the determined characteristic of the object;

attaching the mnemonic device to said object by the attachment means associated with said selected indicant on the mnemonic device;

changing the characteristic of the object;

detaching the mnemonic device from said object;

determining the changed characteristic of the object;

selecting an indicant on the mnemonic device corresponding to the changed characteristic of the object; and reattaching the mnemonic device to said object by the attachment means associated with the indicant on the mnemonic device corresponding to the changed characteristic of the object.

9. A method for identifying a changeable characteristic of an object, as set forth in claim 8, wherein said mnemonic device includes a body portion having a plurality of predefined surface areas each having a respective one of said indicants disposed thereon, and at least a portion of a respective one of said separate attachment means associated with each of said indicants is positioned within each of said surface areas.

10. A method for identifying a changeable characteristic of an object, as set forth in claim 9, wherein each of said separate attachment means associated with each of said indicants comprises an aperture formed in each of said predefined surface areas and adapted to receive a single detachable connector extending through a selected one of said apertures.

11. A method for identifying a changeable characteristic of an object, as set forth in claim 9, wherein said separate attachment means associated with each of said indicants comprises a matable clasp member positioned in unambiguous proximity each of said indicants, and a single mating connector adapted to engage a selected one of said clasp members.

12. A method for identifying a changeable characteristic of an object, as set forth in claim 9, wherein said mnemonic device includes a volumetric measuring utensil and said body portion of the device is fixedly connected to said measuring utensil.

13. A method for identifying a changeable characteristic of a object, as set forth in claim 8, wherein said determining a characteristic of the object and said determining the changed characteristic of the object includes determining the service status of said object.

14. A method for identifying a changeable characteristic of an object, as set forth in claim 8, wherein said determining a characteristic of the object and said determining the changed characteristic of the object includes determining the time at which the next servicing of the object is desired.

* * * * *